United States Patent [19]

Nobileau

[11] Patent Number: 5,025,864

[45] Date of Patent: Jun. 25, 1991

[54] CASING HANGER WEAR BUSHING

[75] Inventor: Philippe C. Nobileau, Paris, France

[73] Assignee: Vetco Gray Inc., Houston, Tex.

[21] Appl. No.: 500,146

[22] Filed: Mar. 27, 1990

[51] Int. Cl.[5] ..... E21B 23/04

[52] U.S. Cl. ..... 166/348; 166/208; 166/382; 166/85

[58] Field of Search ..... 166/348, 82, 85, 208, 166/365, 380, 382; 285/24

[56] References Cited

U.S. PATENT DOCUMENTS 4,340,259 7/1982 Green ..... 106/241 X
4,361,353 11/1982 Vinson ..... 285/404 A
4,674,576 6/1987 Goris et al. ..... 166/182 X
4,903,992 2/1990 Jennings et al. ..... 285/24

*Primary Examiner*—William P. Neuder
*Attorney, Agent, or Firm*—James E. Bradley

[57] ABSTRACT

A wear bushing for a casing hanger mounts to the bore of a casing hanger before the casing hanger is lowered into the well. The running tool for running the casing connects to the wear bushing. The wear bushing has a setting ring that connects to the seal for the casing hanger. The running tool has a setting sleeve that connects to the setting ring. The running tool will release from the wear bushing and the setting ring after the casing has been cemented and the seal set.

5 Claims, 3 Drawing Sheets

CASING HANGER WEAR BUSHING

BACKGROUND OF THE INVENTION

1. Field of the Invention

This invention relates in general to drilling equipment for use in a subsea wellhead, and in particular to a wear bushing which locates on a casing hanger for protecting the casing hanger during drilling operations.

2. Description of the Prior Art

In one type of offshore drilling, the drilling crew will locate a subsea wellhead housing on the sea floor. A riser will extend to a floating drilling vessel at the surface of the water. The drilling crew will lower drill pipe through the riser and wellhead housing to drill the well to a first selected depth.

Then, the drilling crew will lower a string of casing into the well with a casing hanger located at the top of the string. The casing hanger will land in the wellhead housing. The drilling crew pumps cement down the drill pipe, which flows back up the annulus surrounding the casing, cementing the casing string in the well. The drilling crew will than lower the drill pipe with a drill bit on the end for drilling the well to a next selected depth, at a lesser diameter than the upper portion of the well.

Once that depth has been reached, the drilling crew will lower a second and smaller diameter casing string into the first casing string. The drilling crew will land this second casing hanger above the first casing hanger and cement the second casing string in the well.

While the drilling crew drills through casing, there is a possibility that the drill pipe will damage the bore of the casing hanger. It is important to keep the bore of the casing hanger protected for receiving the seals of other equipment, such as a casing hanger or a tubing hanger.

In the prior art, after the casing hanger and casing string are cemented in the well, the drilling crew will lower a wear bushing on drill pipe into the bore of the casing hanger. Once secured in place, the drilling crew retrieves the running tool, then lowers the drill pipe with the drill bit on the lower end for drilling. The wear bushing protects the bore of the casing hanger.

While this is workable, running the wear bushing in a second trip after the casing hanger has been cemented requires additional time. The time could be extensive if the drilling is occurring in deep seas.

SUMMARY OF THE INVENTION

In this invention, the drilling crew runs the casing string, casing hanger and wear bushing all at the same time. The wear bushing releasably latches in the casing hanger. The running tool for running the casing hanger latches to the wear bushing.

The wear bushing includes a ring mounted to the exterior. This ring will slide axially on the exterior of the wear bushing. It has its lower end connected to a seal for sealing the annulus between the casing hanger and the wellhead housing. The ring has an upper end that connects to the running tool.

When lowering the casing string into the well, the ring will be in an upper position, with the packoff located above the casing hanger. The drilling crew lands the casing hanger in the wellhead and cements the casing string. Returns flow past the seal and the wear bushing setting ring. Then, the drilling crew actuates a setting sleeve on the running tool to move the setting ring of the wear bushing downward to set the seal. The drilling crew then retrieves the running tool, leaving the wear bushing, including its ring in place.

After the drilling operations have been completed, the drilling crew will run a retrieving tool into the wear bushing for releasing it from the casing hanger, and releasing the setting ring from the seal.

DETAILED DESCRIPTION OF THE INVENTION

Figure 1A:
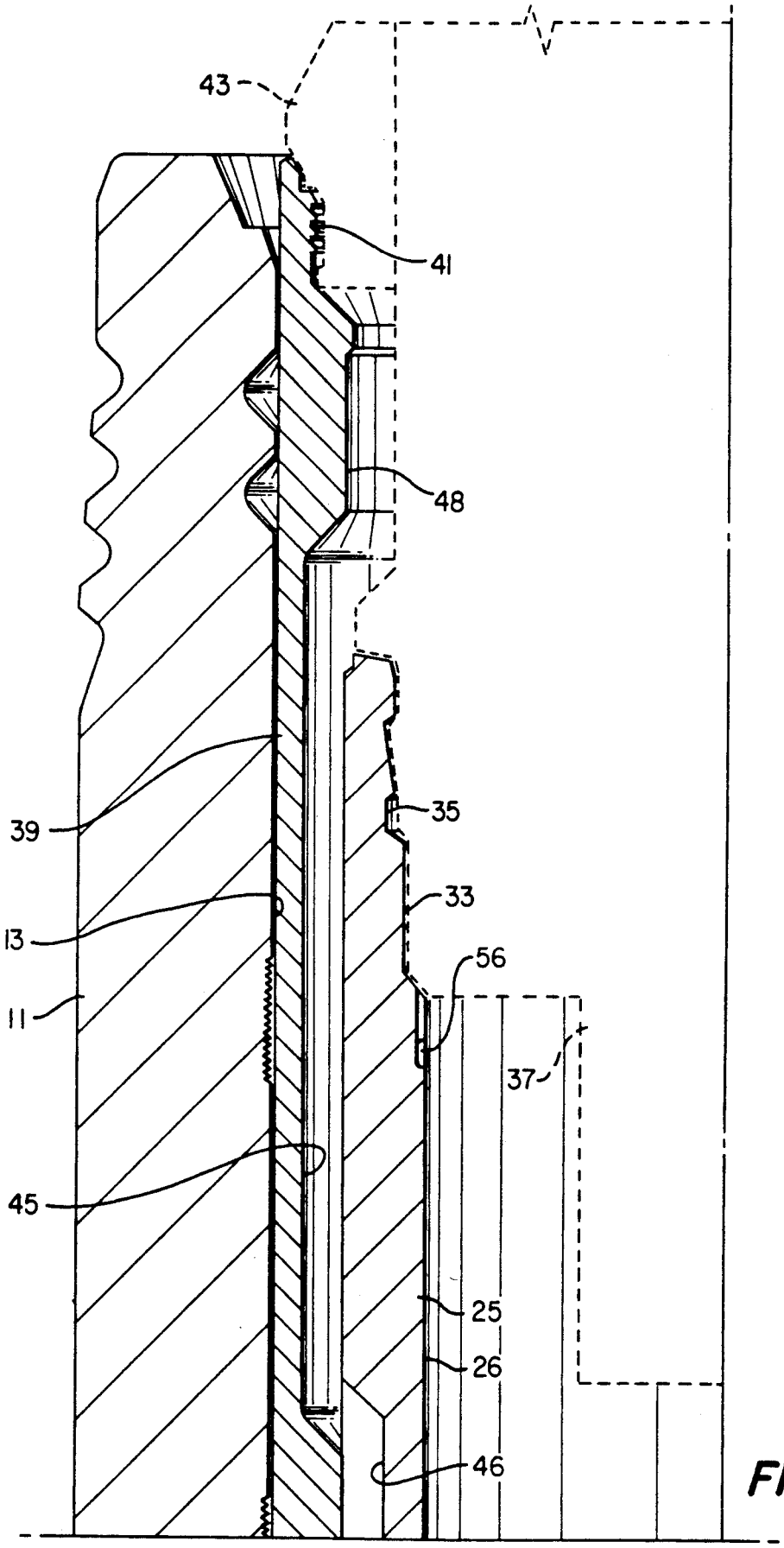
FIGS. 1*a* and 1*b* show in vertical cross section a wear bushing secured to a lower casing hanger, and showing the setting ring of the wear bushing in an upper position.
Figure 1B:
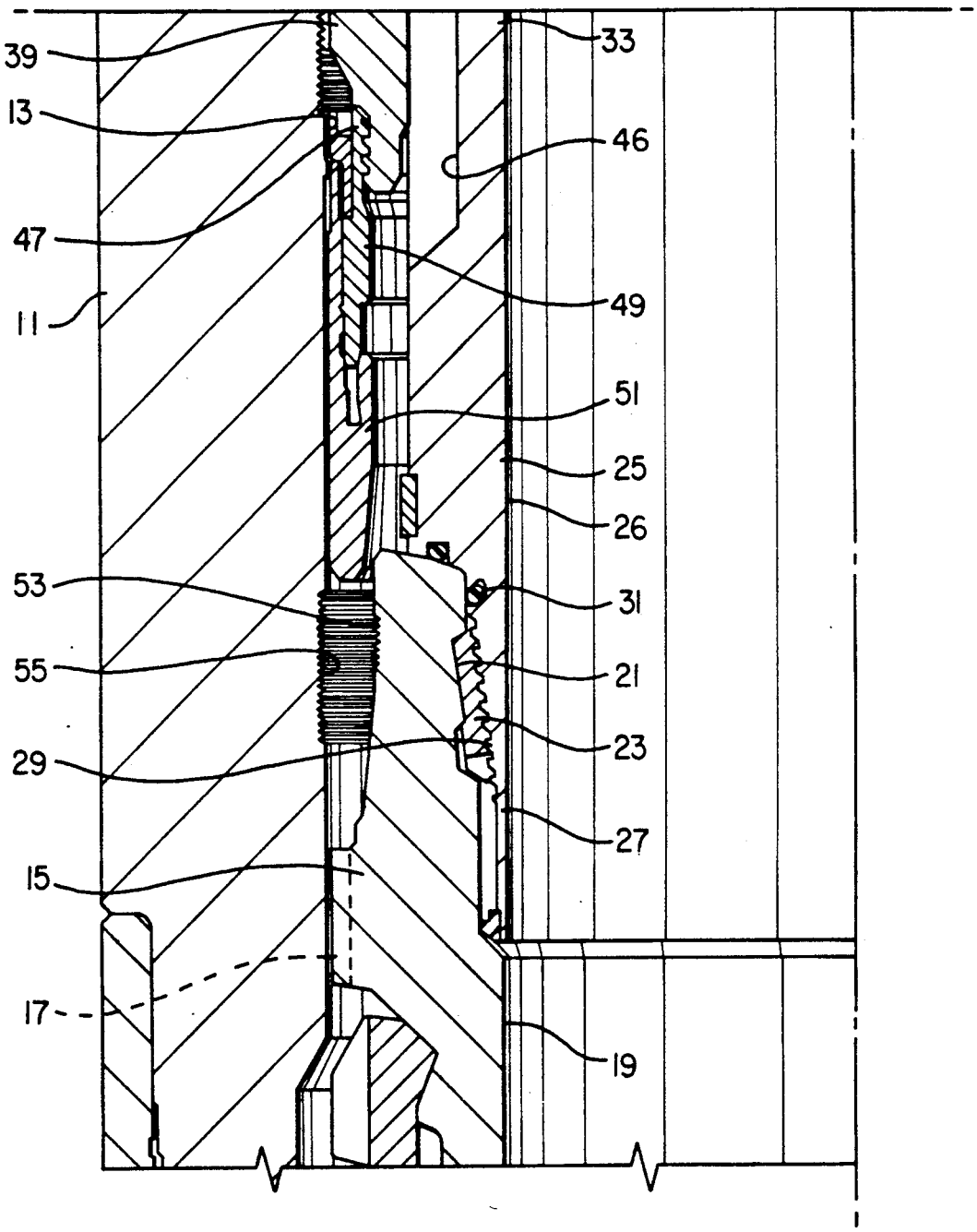

Referring to FIG. 1*a*, wellhead housing 11 is a tubular member located on a subsea floor. Wellhead housing 11 has a cylindrical bore extending axially through it. As shown in FIG. 1*b* a lower casing hanger 15 will land in the wellhead housing 11. The lower casing hanger 15 will be of a conventional type. It will have vertical slots or passages 17 around its exterior for the passage of returns while cementing. The lower casing hanger 15 will be secured to the upper end of a string of casing (not shown).

Lower casing hanger 15 has an axial bore 19. Bore 19 has an upper portion containing a circumferential groove or profile 21. A latch 23 will locate within profile 21. Latch 23 is a split ring having threads on its interior and a mating profile on its exterior. Latch 23, may be of a type shown in U.S. Pat. No. 4,903,922, issued Feb. 27, 1990, Charles E. Jennings, all of which material is hereby incorporated by reference.

Latch 23 serves as means for securing a wear bushing 25 releasably to the casing hanger 15. Latch 23 is carried by the wear bushing 25. Wear bushing 25 is a tubular member that has a bore 26 of the same diameter as the lower portion of bore 19 within the casing hanger 15. Wear bushing 25 has a lower portion 27 that fits within the upper portion of the casing hanger bore 19. Latch 23 locates on the smaller diameter lower portion 27 before the wear bushing 25 is stabbed into the casing hanger 15. The wear bushing 25 has threads 29 on its exterior directly above the lower portion 27. Threads 29 will ratchet into and latch within the latch 23 as the wear bushing 25 stabs into the casing hanger 15. Seals 31 seal the wear bushing 25 to the bore 19 of casing hanger 15.

Wear bushing 25 has an upper portion 33 that extends above the casing hanger 15 a considerable distance. A circumferential groove or profile 35 located in the wear bushing bore 26 near the upper end serves as means for connecting the wear bushing 25 to a running tool 37. Running tool 37 may be of various types. Preferably, it is of a type shown in U.S. patent application Ser. No. 362,843, filed June 6, 1989, H. O. Henderson, et al, all of which material is hereby incorporated by reference. The running tool 37 latches into the profile 35 and will support the weight of the casing hanger 15 and wear bushing 25 for lowering the entire assembly into the well.

Wear bushing 25 has a setting ring 39. The setting ring 39 mounts to the exterior of the wear bushing 25. Setting ring 39 will slide axially relative to the wear bushing 25 between an upper position, shown in FIGS.

1*a* and 1*b*, and a lower position (not shown). Setting ring 39 has circumferential grooves 41 located within its interior near its upper end. Grooves 41 serve as means for connecting the setting ring 39 to a setting sleeve 43. The setting sleeve 43 is a part of the running tool 37. Setting sleeve 43 will move axially relative to the portion of the running tool 37 that secures to the profile 35.

The setting ring 39 has a plurality of vertical channels 45 located within its interior for allowing the passage of cement returns. The channels 45 extend down only a portion of the length of the setting ring 39. The lower ends of the channels 45 will register with the upper ends of channels 46 when the setting ring 39 is in the upper position shown in FIG. 1*a*.

Channels 46 are formed on the exterior of the wear bushing 25. When the setting ring 39 is in the lower position (not shown), the upper ends of the channels 45 will be blocked due to an upper portion 48 of the interior of the setting ring 39 slidingly engaging the exterior of the wear bushing 25.

The setting ring 39 has a lower end that contains grooves 47, as shown in FIG. 1*b*. Grooves 47 serve as means for connecting the setting ring 39 to an energizing ring 49. Energizing ring 49 is part of a conventional metal-to-metal seal assembly. The seal assembly includes a metal seal 51. The energizing ring 49 will move into an annular channel located between inner and outer walls of the seal 51, to expand the seal walls apart for setting the seal 51. The seal 51 will seal against wickers 53 formed on the exterior of the casing hanger 15 and wickers 55 formed in the bore 13 of the wellhead housing 11.

The wear bushing 25 has a plurality of vertical slots 56, shown in FIG. 1*a*, that are used for retrieving the wear bushing 25. A conventional retrieval tool (not shown), having means to apply torque to the slots 56 and latch into the wear bushing 25 will be utilized. This enables the wear bushing threads 29 to be unscrewed from the latch 23 when retrieval is desired.

In operation, first the casing hanger 15 will be secured to the upper end of a string of casing (not shown). The energizing ring 49 of seal 51 will be secured to the grooves 47 on the lower end of the setting ring 39. The drilling crew will install the wear bushing 25 in the casing hanger 15. Initially, the latch 23 will be located on the wear bushing 25 in a position below the threads 29. During installation, the crew will lower the wear bushing 25 into the casing hanger 15. The latch 23 will expand outward into the casing hanger profile 21. The threads 29 will ratchet into the latch 23, securing the wear bushing 25 to the casing hanger 15.

The grooves 41 on the upper end of the setting ring 39 will be secured to the setting sleeve 43 of the running tool 37. The running tool 37 will be latched to the profile 35 within the wear bushing 25. The drilling crew secures the running tool 37 to a string of drill pipe and lowers the entire assembly into the well. The wear bushing 25 supports the weight of the casing string as it is lowered into the well.

The drilling crew lands the casing hanger 15 in the wellhead housing 11. The crew will then pump cement down the drill pipe, through the running tool 37, through the wear bushing bore 25 and through the casing hanger bore 19. The cement will return up the annulus surrounding the string of casing. Displaced drilling mud will flow through the channels 46 and 45 up the riser string (not shown).

After cementing has been completed, the drilling crew will operate the running tool 37 to move the setting sleeve 43 downward. This causes the setting ring 39 to move downward, and positions the seal 51 between the casing hanger 15 and the wellhead housing 11. The drilling crew applies hydraulic force to the setting sleeve 43, causing the energizing ring 49 to expand the inner and outer walls of the metal seal 51 apart to set the seal. The drilling crew then pulls upward on the running tool 37 to release the setting sleeve 43 from the setting ring 39. The crew releases the running tool 37 from the wear bushing 25. The crew then pulls the running tool 37 to the surface.

The well is now ready for additional drilling. The crew lowers the drill string back into the well with a drill bit. The crew will drill through the casing that is secured to the casing hanger 15. The wear bushing 25 will protect the upper portion of the bore 19 of the casing hanger 15 from damage during drilling.

After the drilling crew completes the drilling, they will retrieve the drill pipe and lower a retrieval tool (not shown), which may be cf a conventional nature. The retrieval tool will latch into the wear bushing 25. The retrieval tool will have a key which will locate within the slots 56 in the upper portion of the bore 26 of the wear bushing 25. The crew will rotate the drill string and the wear bushing 25. This causes the wear bushing threads 29 to unscrew from the latch 23. The crew then will pick up the wear bushing 25. The latch 23 will spring back out of the profile 21 once the threads 29 have cleared the latch 23. Latch 23 will be retrieved to the surface along with the wear bushing 25. The upward pull by the drill pipe will also pull the setting ring 39 loose from the energizing ring 49 of the metal seal 51.

Figure 2:
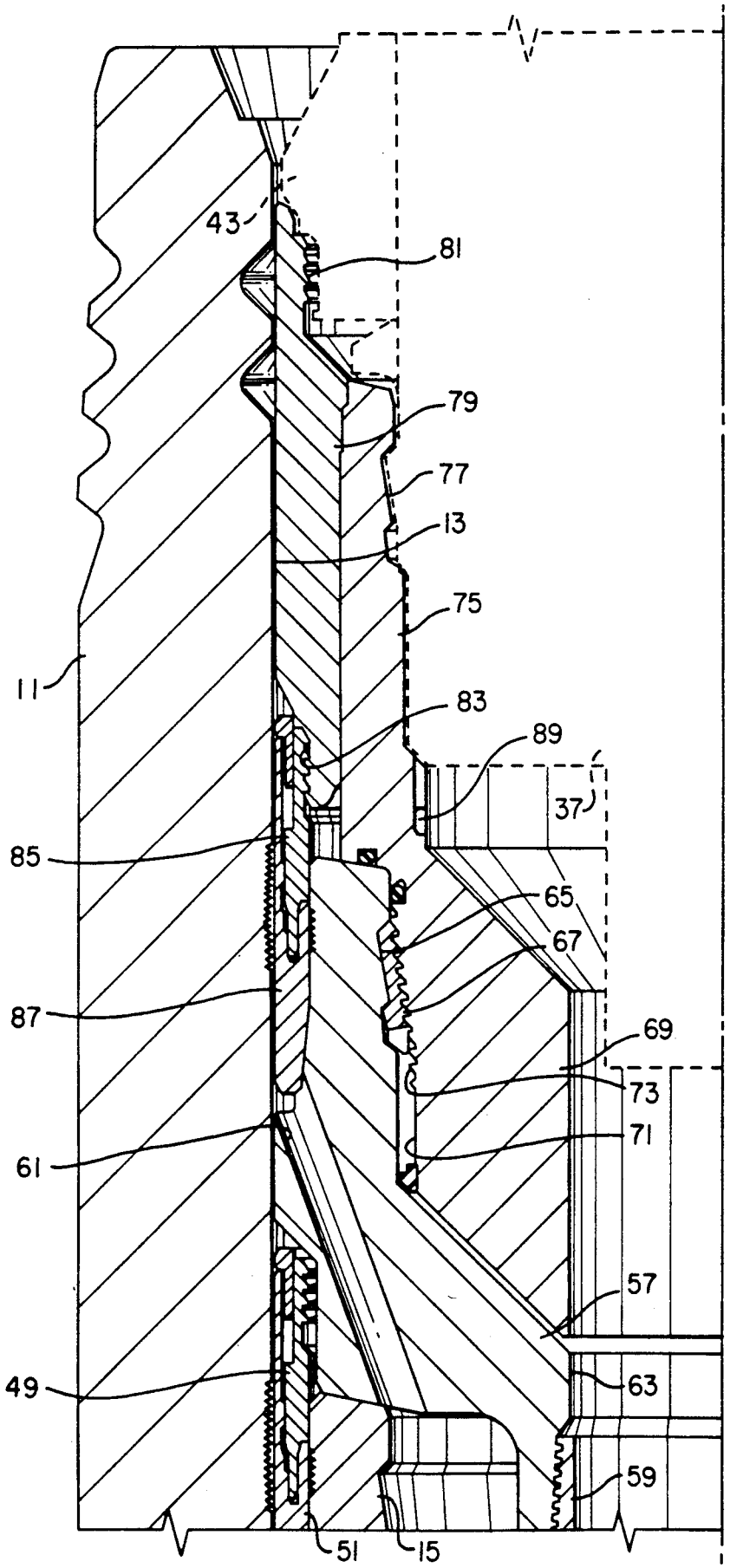
FIG. 2 illustrates in a vertical quarter section a wear bushing secured to an upper casing hanger and showing the setting ring of the wear bushing in a lower position.

The drilling crew will then lower an upper casing hanger 57 on top of the lower casing hanger 15, as shown in FIG. 2. The upper casing hanger 57 is secured to a string of casing 59 of smaller diameter than the casing that was secured to the lower casing hanger 15. Upper casing hanger 57 has passages 61 on its exterior for fluid return during cementing. Upper casing hanger 57 has a bore 63 that extends through it axially. The upper portion of the bore 63 is enlarged. Similar to the casing hanger 15, this upper portion contains a groove or profile 65 for receiving a latch 67.

Latch 67 will be of the same type as latch 23 shown in FIG. 1*b*. A wear bushing 59 will releasably secure to the casing hanger 57. Wear bushing 69 has a lower portion 71 that extends into the upper portion of the casing hanger bore 63. Threads 73 on the wear bushing lower portion 71 engage the latch 67.

Wear bushing 69 has an upper portion 75 that protrudes above the top of the casing hanger 57. A groove or profile 77 locates in the interior of the wear bushing upper portion 75. The same running tool 37 will secure within the profile 77.

A setting ring 79 will move axially on the exterior of the wear bushing 69. Setting ring 79, similar to setting ring 39, has grooves 81 on its upper end for connection to the setting ring 39 of the running tool 37. Grooves 83 on the lower end of the setting ring 79 will engage an energizing ring 85. Energizing ring 85 is a part of a metal-to-metal seal 87 of the same type as the seal 51 of FIG. 1*b*. A slot 89 located in the interior of the wear bushing 69 provides means for retrieving the wear bushing 69. Channels (not shown) will also extend vertically within the setting ring 79 for cement returns.

The operation of the wear bushing 69 is the same as the operation of the wear bushing 25. The wear bushing 69 latches to the casing hanger 57. The running tool 37 latches to the wear bushing 69. The entire assembly will be lowered into the well and landed on top of the casing hanger 15.

After cementing, the setting sleeve 39 of the running tool 37 moves the setting ring 79 downward. This causes the seal 87 to locate between the casing hanger 57 and the wellhead housing 11. The energizing ring 85 will set the seal 87. The running tool 37 releases from the wear bushing 69. The drilling crew retrieves the running tool 37 and lowers a drill bit for drilling through the casing 59.

The wear bushing 69 will be retrieved from the casing hanger 57 in the same manner as the wear bushing 25. A retrieving tool (not shown) will latch into the wear bushing 69. It will engage the slots 89 to apply torque to the wear bushing 69. This unscrews the wear bushing 69 from the latch 67. The drilling crew picks up on the wear bushing 69. The latch 67 will spring inward from profile 65, enabling the wear bushing 69 to be pulled to the surface. The setting ring 79 will detach from the energizing ring 85.

The invention has significant advantages. The wear bushing serves to run the casing hanger. It also serves in setting the seal for the casing hanger. The wear bushing allows the drilling crew to commence drilling without an additional trip to run the wear bushing after the casing hanger has been cemented.

While the invention has been shown in only one of its forms, it should be apparent to those skilled in the art that it is not so limited, but is susceptible to various changes without departing from the scope of the invention.

I claim:

1. In a subsea well of the type having a wellhead housing which supports a casing hanger secured to the upper end of a string of casing, the casing hanger having an axial bore and being surrounded by an annulus for receiving a seal between the casing hanger and the wellhead housing, the improvement comprising in combination:

a wear bushing;

an annular profile formed in the bore of the casing hanger;

means for securing the wear bushing to the annular profile for releasably mounting the wear bushing within the bore of the casing hanger;

means for releasably securing the wear bushing to a running tool for lowering the wear bushing and casing hanger into the wellhead housing;

a ring mounted to the exterior of the wear bushing for axial movement relative to the wear bushing, the ring having a lower end;

means for releasably securing the seal to the lower end of the ring; and means for securing the running tool to the ring for moving the ring axially downward after the casing hanger lands in the wellhead, for setting the seal.

2. In a subsea well of the type having a wellhead housing which supports a casing hanger having a lower end secured to the upper end of a string of casing, the casing hanger having an axial bore and being surrounded by an annulus for receiving a seal between the casing hanger and the wellhead housing, the improvement comprising in combination:

a tubular wear bushing having a lower portion which locates in the bore of the casing hanger and an upper portion which protrudes upward from an upper end of the casing hanger;

an annular profile formed in the bore of the casing hanger;

means on the exterior of the lower portion of the wear bushing for securing the wear bushing to the annular profile for releasably mounting the wear bushing within the bore of the casing hanger;

means located in the interior of the upper portion of the wear bushing for releasably securing the wear bushing to a running tool for lowering the wear bushing and casing hanger into the wellhead housing;

a ring mounted to the exterior of the wear bushing for axial sliding movement relative to the wear bushing, the ring having a lower portion and an upper portion;

means for releasably securing the seal to the lower portion of the ring; and means for securing the running tool to the upper portion of the ring for moving the ring axially downward after the casing hanger lands in the wellhead, for setting the seal.

3. In a subsea well of the type having a wellhead housing which supports a casing hanger having a lower end secured to the upper end of a string of casing, the casing hanger having an axial bore and being surrounded by an annulus for receiving a seal between the casing hanger and the wellhead housing, the improvement comprising in combination:

a tubular wear bushing having a lower portion which located in the bore of the casing hanger and an upper portion which protrudes upward from an upper end of the casing hanger;

an annular latch profile located in the bore of the casing hanger;

latch means including an annular latch carried on the exterior of the lower portion of the wear bushing for releasably engaging the latch profile for mounting the wear bushing within the bore of the casing hanger;

means including at least one running tool profile located in the interior of the upper portion of the wear bushing for releasably securing the wear bushing to a running tool for lowering the wear bushing and casing hanger into the wellhead housing;

a ring mounted to the exterior of the wear bushing for axial sliding movement relative to the wear bushing, the ring having a lower portion and an upper portion;

means including at least one groove on the lower portion of the ring for releasably securing the seal to the lower portion of the ring; and means including at least one groove on the upper portion of the ring for securing the running tool to the upper portion of the ring for moving the ring axially downward after the casing hanger lands in the wellhead, for setting the seal.

4. In a subsea well of the type having a wellhead housing which supports a casing hanger secured to the upper end of a string of casing, the casing hanger having an axial bore and being surrounded by an annulus for receiving a seal between the casing hanger and the wellhead housing, the improvement comprising in combination:

a wear bushing;

an annular latch profile located in the bore of the casing hanger;

an annular latch mounted to the exterior of the wear bushing and releasably engageable with the latch profile for releasably mounting the wear bushing within the bore of the casing hanger;

means for releasably securing the wear bushing to a running tool for lowering the wear bushing and casing hanger into the wellhead housing;

a ring mounted to the exterior of the wear bushing for axial movement relative to the wear bushing, the ring having a lower end;

means for releasably securing the seal to the lower end of the ring;

means for securing the running tool to the ring for moving the ring axially downward after the casing hanger lands in the wellhead, for setting the seal; and axially extending channels on the exterior of the wear bushing and in the interior of the ring for the passage of returns during cementing.

5. A method of mounting a casing hanger within a subsea well of the type having a wellhead housing, the casing hanger having an axial bore and being surrounded by an annulus for receiving a seal between the casing hanger and the wellhead housing, the method comprising in combination:

securing the casing hanger to the upper end of a string of casing;

providing an annular profile in the bore of the casing hanger;

releasably mounting the wear bushing to the annular profile within the bore of the casing hanger;

mounting a ring to the exterior of the wear bushing for axial movement relative to the wear bushing;

releasably securing a seal to the lower end of the ring;

releasably securing the wear bushing to a running tool;

securing the running tool to the ring; then lowering the wear bushing and casing hanger into the wellhead housing; then cementing the casing string; then moving the ring axially downward and setting the seal between the casing hanger and wellhead housing; then removing the running tool; then continuing drilling operations through the casing string, with the wear bushing protecting the casing hanger; then removing the wear bushing from the casing hanger when the drilling operations have been completed.

* * * * *